United States Patent [19]

Jung

[11] 4,280,422

[45] Jul. 28, 1981

[54] GUIDE DEVICE FOR SEWING MACHINES

[75] Inventor: Arno Jung, Fischbach, Fed. Rep. of Germany

[73] Assignee: Pfaff Industriemaschinen GmbH, Fed. Rep. of Germany

[21] Appl. No.: 188,941

[22] Filed: Sep. 19, 1980

[30] Foreign Application Priority Data

Oct. 6, 1979 [DE] Fed. Rep. of Germany ..... 2940552

[51] Int. Cl.[3] ..... D05B 35/00

[52] U.S. Cl. ..... 112/147; 112/153; 112/235

[58] Field of Search ..... 112/147, 136, 153, 141, 112/142, 143, 148, 150, 235

[56] References Cited

U.S. PATENT DOCUMENTS

| | | | |
|---|---|---|---|
| 2,096,691 | 10/1937 | Ackerman et al. | 112/147 |
| 2,755,753 | 7/1956 | Kratz et al. | 112/147 |
| 2,900,936 | 8/1959 | Reid | 112/147 |
| 4,034,690 | 7/1977 | Breck, Jr. | 112/147 X |

*Primary Examiner*—H. Hampton Hunter
*Attorney, Agent, or Firm*—McGlew and Tuttle

[57] ABSTRACT

A guide device for a sewing machine, having a needle for sewing a stitch line in a sewing direction and a presser bar, for sewing together fabric plies of unequal thickness, comprises, a main sole part, with a stitch hole for the passage of the needle, connected to the presser bar, an auxiliary sole part connected to the presser bar having a first fold plate positioned upstream of the stitch hole in the sewing direction, and a second fold plate connected to the sewing machine and spaced at least one fabric thickness above the first fold plate. The first fold plate includes a guide edge extending laterally beyond the stitch line on one side thereof and the second fold plate has a guide edge extending laterally beyond the stitch line on an opposite side thereof, whereby, the first and second fold plates define a guide channel therebetween for forming and guiding an S-shape fold in the fabric.

10 Claims, 2 Drawing Figures

GUIDE DEVICE FOR SEWING MACHINES

FIELD AND BACKGROUND OF THE INVENTION

The present invention relates to sewing machines in general and, in particular, to a new and useful guide device for sewing machines having a presser foot for sewing together fabric plies of unequal thickness.

Guide devices for sewing machines having a presser foot for sewing together plies of unequal thickness, including a main sole part with a stitch hole and an auxiliary sole part arranged laterally spaced from a stitch formation line and vertically movable on a shank part are known from German Pat. No. 615,718 and U.S. Pat. No. 3,146,743. They serve for the sewing together of fabric plies of unequal thickness, such as sewing the neckband of a shirt to the top collar when making a so-called two-piece collar, as well as for the uniform pressing of the two unequally thick collar components against a feed plate and stitch plate and also for guiding the work along the edge of the thicker collar component.

While it is considerably more expensive to make a two-piece collar than a so-called one-piece collar, where the top collar and neckband are made from one piece of fabric, the fit of a two-piece collar is much better, because the edges to be joined by a seam in the two-piece collar fold of the separately prepared neckband and the likewise separately prepared top collar can be given a form differing from each other such that the finished collar is given its desired three-dimensional shape by the seam connection at the differently patterned edges.

In order to obtain this quality-essential advantage in the much cheaper one-piece collar structure, it has been proposed to make the usual stiffening insert of the one-piece collar, which is to be bonded or welded to the outer fabric of the collar, with a three-part fold line zone in strips of a certain form and with a stiffness differing from the other regions. This permits the S-shape folding of the outer fabric joined to the stiffening insert along the collar fold, which corresponds to the line of separation between the neckband and the top collar in the two-piece collar and makes it possible to sew it exactly along the fold line, thereby achieving the effect of three-dimensional shaping as in the two-piece collar.

SUMMARY OF THE INVENTION

The purpose of the present invention is to facilitate the handling of the outer fabric joined to the described stiffening insert in a one-piece collar. The problem is to provide means which permit the easy S-shape folding and exact guiding of the work along a fold edge.

Accordingly, an object of the present invention is to provide a guide device for a sewing machine having a needle for sewing a stitch line in a sewing direction and a presser bar for sewing together fabric plies of unequal thickness, comprising, a main sole part, with a stitch hole for the passage of the needle, connected to the presser bar, an auxiliary sole part connected to the presser bar having a first fold plate positioned upstream of the stitch hole in the sewing direction, the first fold plate having a guide edge extending laterally beyond the stitch line on one side thereof, and a second fold plate connected to the sewing machine and spaced at least one fabric thickness above the first fold plate, the second plate having a guide edge extending laterally beyond the stitch line on the other side thereof, the first and second fold plates forming a guide channel therebetween for the formation of an S-shape fold and the guiding of the S-shape fold toward the needle.

Another object of the invention is to provide a guide which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

DESCRIPTION OF THE PREFERRED EMBODIMENT

Figure 1:
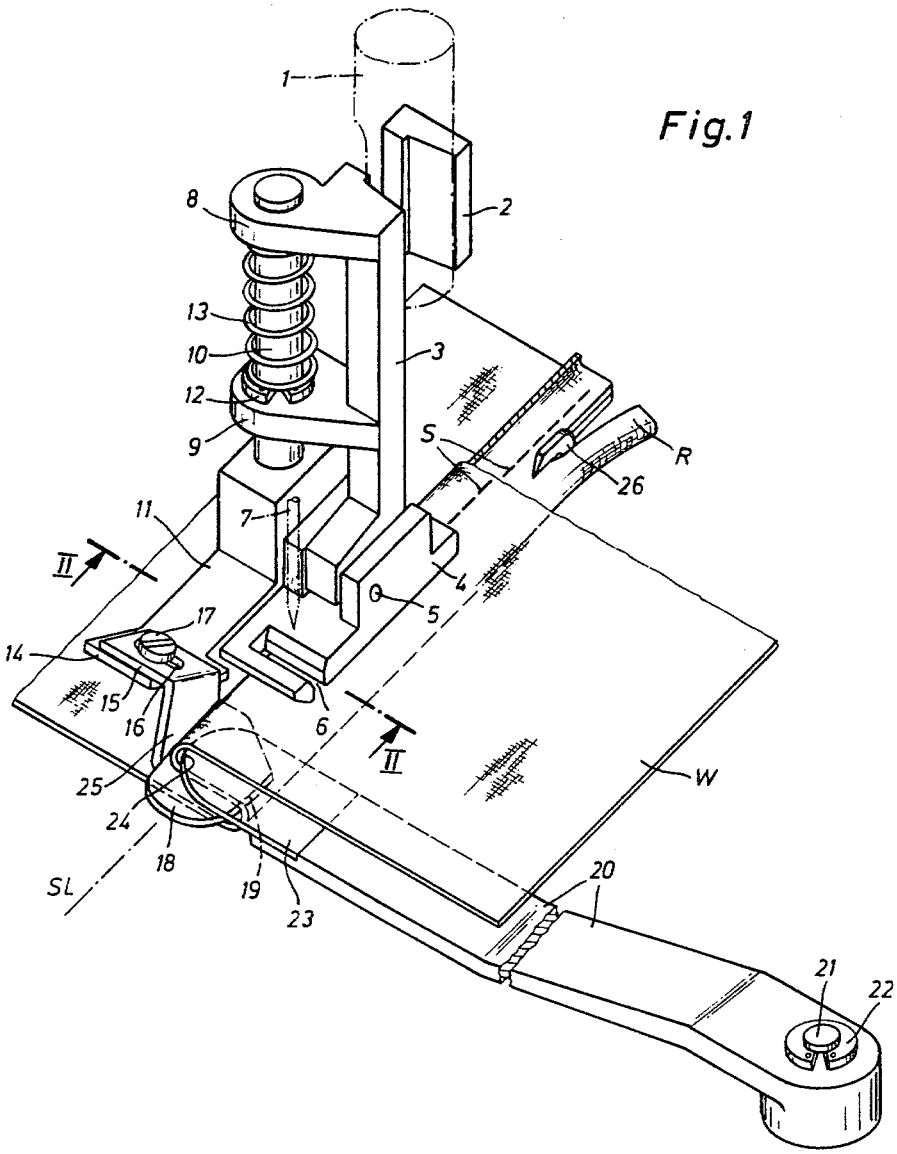
FIG. 1 is a top perspective view of the inventive guide device with means for folding and guiding a collar cut connected with a stiffening insert.
Figure 2:
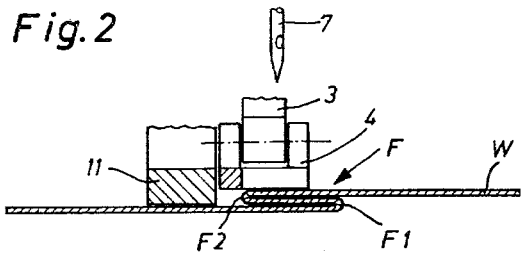
FIG. 2 is a section taken along the line II—II of FIG. 1.

Referring to the drawing in particular, the invention embodied therein, comprises, a guide device for a sewing machine having a needle 7 for sewing a stitch line SL in a sewing direction and a presser bar 1 for sewing together fabric plies of unequal thickness.

A shank part 2 of a presser foot is fastened to a spring-urged presser bar 1 of a sewing machine. A downwardly extending leg 3 is connected to the shank 2, and carries a main sole part 4 which is pivotably mounted thereon by means of a pin 5. A unilaterally open slot 6 is in the toe region of the main sole part 4. Open slot 6 acts as a stitch hole for the passage of a thread-carrying needle 7, which cooperates with the usual shuttle of the sewing machine to form the seam. Two horizontal bearing brackets 8 and 9 of shank part 2 have bores in which a cylindrical guide rod 10 is received for longitudinal displacement.

An auxiliary sole part 11 is pressed against a stitch plate (not shown) or a feed plate (not shown) of the sewing machine by a compression spring 13 placed on the guide rod 10 and disposed between bracket 8 and a snap ring 12 clamped on guide rod 10. Auxiliary sole part 11 includes a toe part 14 which extends obliquely upwardly, and on which an angle piece 15 is fastened by means of a screw 17 which is passed through a longitudinal slot 16 in its leg adapted to the slant of the toe part 14. The angle piece is adjustable cross-wise to the stitch formation line SL to enable the varying of the width of the S-shape fold F. A first horizontal fold plate 18 located before or upstream of the stitch hole 6 extends from the vertical leg of angle piece 15. The guide edge 19 of the fold plate extends laterally beyond the stitch formation line SL.

On the side of the stitch formation line SL, opposite the auxiliary sole part 11, a support 20 is pivotably mounted about a spindle 21 fastened in the work supporting plate of the sewing machine and is secured on the spindle 21 by a snap ring 22. A second fold plate 23 is fastened, for example, by soldering on the free end of support 20. The guiding edge 24 of fold plate 23 extends almost to the lateral face 25 of the angle piece 15 which is fastened to the auxiliary sole part 11. In the operating position shown in the drawing, which, if necessary, may be fixable by an adjustable stop, the second fold plate 23 is above the first fold plate 18 spaced by at least one fabric ply or width of the work W. In this position, the fold plates 18 and 23, together with the lateral face 25 of the angle piece 15, fastened to the auxiliary sole part 11, form a guide for forming and guiding an S-shape fold F in the work W.

To reduce the accumulation of material next to the seam S, a hook-shape trimming knife 26, driven in a known manner, is provided behind the stitch formation point. Knife 26 passes upwardly through an opening in the stitch plate of the sewing machine and trims the edge R of the folded part of the S-shape fold F located below the upper ply of the work W, next to the seam S.

For greater clarity, trimming knife 26 is shown in the drawing at a relatively large distance behind or downstream of the stitch formation point, but in reality, it is disposed just behind or downstream of the needle 7. For easier insertion of the work, the knife can be lowered under the stitch plate.

The mode of operation is as follows:

In handling a work or workpiece W, as for example, a collar cut, consisting of an outer fabric and a stiffening insert made of a three-part fold line zone, bonded or welded to the outer fabric, the support 20, with the second fold plate 23, is pivoted away forward about the spindle 21 for insertion of the work W and the shank part 2, fastened to the presser bar 1 with the main sole part 4 and auxiliary sole part 11, as well as the angle piece 15 fastened thereto, with the first fold plate 18, is lifted. The fold line zone has a stiffness which is different from other zones of the work and determines the course of the S-shape fold to be formed and facilitates the formation thereof.

The workpiece W is then placed under the first fold plate 18 so that the first fold edge F1 of the S-shape fold F will be next to the guide edge 19 of the first fold plate 18 and the front edge of the work W extends to directly in front of the main sole part 4. Together with the presser bar 1, the sole parts 4 and 11 on shank part 2 are then lowered. The front edge of auxiliary sole part 11 and the first fold plate 18 come down on the work W and press it against the stitch plate or feed plate of the sewing machine.

Thereupon, the part of fold F later located internally is folded around the guide edge 19 of the first fold plate 18 and then the support 20, with the second fold plate 23 is swung, as shown in FIG. 1, under the workpiece W into the operating position; the second fold edge F2 is formed, into which the guide edge 24 of fold plate 23 inserts itself. Thus, the S-shape fold F is completed in the region of the front edge of the workpiece W.

The fold is fixed by the seam S in the subsequent sewing operation, with the guide edges 19 and 24, together with the lateral face 25 of the angle piece 15 fastened to the auxiliary sole part 11, constituting a guide way for forming and guiding the S-shape fold F in the remaining length of the work W. During the sewing operation, the edge R of the folded part of fold F lying under the upper ply is cut off by the trimming knife 26, to avoid an accumulation of material next to the seam S.

While a specific embodiment of the invention has been shown and described in detail to illustrate the application of the principles of the invention, it will be understood that the invention may be embodied otherwise without departing from such principles.

What is claimed is:

1. A guide device for a sewing machine, having a needle for sewing a stitch line in a sewing direction and a presser bar, for sewing together fabric plies of unequal thickness, comprising, a main sole part, with a stitch hole for the passage of the needle, connected to the presser bar, an auxiliary sole part connected to the presser bar having a first fold plate positioned upstream of the stitch hole in the sewing direction, the first fold plate having a guide edge extending laterally beyond the stitch line on one side thereof, and a second fold plate connected to the sewing machine and spaced at least one fabric thickness above the first fold plate, the second fold plate having a guide edge extending laterally beyond the stitch line on an opposite side thereof; the first and second fold plates forming a guide channel therebetween for forming an S-shape fold and for guiding the S-shape fold toward the needle.

2. A guide device for a sewing machine, as claimed in claim 1, including a leg member connected to said presser bar, said main sole part being pivotally mounted to said leg member, said auxiliary sole part being slidably mounted on said leg and having biasing means for biasing the auxiliary sole part downwardly.

3. A guide device for a sewing machine, as claimed in claim 2, wherein said main sole part is pivotally mounted about a horizontal axis extending transversely to the stitch line.

4. A guide device for a sewing machine, as claimed in claim 1, wherein said first fold plate is mounted for lateral positioning and adjustment on said auxiliary sole part for varying the width of the S-shape fold.

5. A guide device for a sewing machine, as claimed in claim 1, wherein said second fold plate is connected to a support which is pivotally mounted about a vertical axis to the sewing machine.

6. A guide device for a sewing machine, as claimed in claim 1, including a trimming knife extending in a path of the S-shape fold and on one lateral side of the stitch line downstream of the stitch hole for trimming a portion of the S-shape fold.

7. A guide device on a sewing machine, for sewing a stitch line in a sewing direction, and having a presser foot for the sewing together of fabric plies of unequal thicknesses, including a main sole part with stitch hole and an auxiliary sole part spaced from the stitch line and vertically movable on a shank part of the sewing machine, comprising, an auxiliary sole part (11) carrying a first fold plate (18) mounted upstream of the stitch hole (6) of the main sole part (4) in a direction of sewing and extending by a guide edge (19) of the first fold plate to laterally beyond the stitch line (SL) and a second fold plate (23) spaced by at least one fabric ply above said first fold plate which extends by a guide edge (24) of said second fold plate from the side of the stitch line (SL) laterally opposite to the auxiliary sole part (11) and which, together with the first fold plate (18) and a lateral face (25) of the auxiliary sole part (11), forms a guide for the forming and guiding of an S-shaped fold F.

8. A guide device on a sewing machine, as claimed in claim 7, wherein the fold plates (18,23) are followed by a trimming knife (26) passing upwardly through an opening in a stitch plate of the sewing machine for trimming an edge (R) of the folded part, lying under a top ply, of the S-shape fold (F) next to a seam (S).

9. A guide device on a sewing machine, as claimed in claim 7 wherein the first fold plate (18) is adjustable laterally to the stitch line (SL).

10. A guide device on a sewing machine, as claimed in claim 7 wherein the second fold plate (23) is mounted pivotably about a vertical axle (21).

* * * * *